United States Patent [19]

Chow

[11] 4,192,464

[45] Mar. 11, 1980

[54] COMPRESSED AIR SPRAYER

[75] Inventor: Ho Chow, River Edge, N.J.

[73] Assignee: Beatrice Foods Co., Chicago, Ill.

[21] Appl. No.: 947,509

[22] Filed: Oct. 2, 1978

[51] Int. Cl.[2] ..... B05B 9/04; B65D 25/28

[52] U.S. Cl. ..... 239/373; 220/94 R; 222/466; 239/375; 417/234

[58] Field of Search ..... 169/30, 33; 222/385, 222/465, 466, 475; 220/91, 94 R; 417/234; 239/373, 375

[56] References Cited

U.S. PATENT DOCUMENTS

| | | | |
|---|---|---|---|
| 280,410 | 7/1883 | Spawn | 169/33 |
| 300,948 | 6/1884 | Caryl | 169/33 |
| 1,875,992 | 9/1932 | Clifford | 222/475 X |
| 2,180,606 | 11/1939 | Oys et al. | 220/94 R |
| 2,705,580 | 4/1955 | Mack | 222/475 |

*Primary Examiner*—Robert B. Reeves
*Assistant Examiner*—Andres Kashnikow
*Attorney, Agent, or Firm*—James & Franklin

[57] ABSTRACT

A hand-pressurized compressed air sprayer includes a handle comprising a grasping portion remote from the sprayer tank and adapted to be held by the user and a connecting portion connecting the grasping portion to the tank. The handle is movable between a first generally vertical position wherein the grasping portion extends over the tank cap so as to enable carrying of the sprayer by the handle, a second stable position wherein the grasping portion is disposed to one side of the first position of the grasping portion and laterally beyond the cap so as to secure the tank against rotation without impeding removal of the cap therefrom for filling purposes, and a third stable position wherein the grasping portion is disposed to the other side of the first position of the grasping portion and laterally beyond the operative path of the pump handle so as to stabilize the tank against vertical lifting or tipping without impeding movement of the pump handle and while providing a support for the user.

19 Claims, 5 Drawing Figures

COMPRESSED AIR SPRAYER

BACKGROUND OF THE INVENTION

The present invention relates in general to a hand-pressurized compressed air sprayer and, more particularly, to such a sprayer including a handle movable between different positions for different purposes.

Generally a hand-pressurized compressed air sprayer comprises a tank for holding the fluid to be sprayed, the tank having an open top through which fluid is introduced into the tank. A cap is removably secured to the tank to cover the open tank top after filling, the cap being removable by rotation and lifting thereof relative to the tank to enable filling of the tank with fluid. Pump means are operably secured to the tank for compressing air therein, the pump means generally including a manually operable pump handle means extending upwardly from the cap and being movable through an operative path along a generally vertical axis extending through the cap.

Typically the sprayer further includes a handle comprising a grasping portion remote from the tank and adapted to be held by a user and one or more connecting portions connecting the grasping portion to the top of the tank. The handle is generally movable between a first generally vertical position wherein the grasping portion extends over the cap and a second stable and more horizontal position wherein the grasping portion is disposed to one side of the grasping portion in the first position. The handle in the first position enables carrying of the sprayer by the handle, although blocking removal of the cap from the tank, while the handle in the second position is adapted to secure the tank against rotation without impeding removal of the cap for filling purposes.

Such sprayers have not, however, been found to be entirely satisfactory in use. In some cases it has been found that the handle is in a position which interferes with the user moving the pump handle means upwardly and downwardly as necessary to pressurize the air within the tank. Furthermore, the tank has a tendency to lift vertically or tip during the pressurizing operation (especially on the upstroke of the pump handle means), and the handle has no stable position which can be employed to counteract this undesirable tendency without also interfering with the pressurizing operation. While the user can employ a free hand to stabilize the tank in some instances, in other instances—e.g., where the fluid within the tank is at an extreme temperature—this may be impractical, and it is in any event difficult and awkward. Finally while the user bends over the tank to effect with one hand the requisite up-and-down movement of the pump handle means during the pressurization operation, he must by his own musculature support his upper torso in the horizontal position as there is nothing save the tank itself upon which he can lean for support with his free hand. This, of course, renders the pressurizing operation even more fatiguing and burdensome.

Accordingly, it is an object of the present invention to provide a hand-pressurized compressed air sprayer in which the handle is movable to a third stable position which does not interfere with the pressurizing operation, which stabilizes the tank against vertical lifting or tipping during the pressurizing operation without impeding movement of the pump handle means, and which facilitates the pressurizing operation by providing a support for the user.

Another object is to provide such a sprayer in which the grasping portion of the handle in its third stable position is disposed higher than the tank and only slightly laterally spaced from the pump handle means to facilitate the pressurizing operation.

A final object is to provide such a sprayer which is easy to carry, easy to fill and easy to pressurize.

SUMMARY OF THE INVENTION

It has now been found that the above and related objects of the present invention are obtained in a hand-pressurized compressed air sprayer in which the handle is movable not only to the first and second positions described hereinabove, but also to a third stable position adapted to secure the tank against vertical lifting or tipping without impeding movement of the pump handle means during pressurization and while providing a support for the user.

More particularly, the hand-pressurized compressed air sprayer comprises a tank for holding fluid, the tank having an open top. A cap is removably secured to the tank to cover the open tank top. A pump means is operably secured to the tank for compressing air therein, the pump means including a manually operated handle means extending upwardly from the cap and being movable through an operative path along a generally vertical axis extending through the cap.

The handle comprises a grasping portion remote from the tank and adapted to be held by a user, and a connecting portion connecting the grasping portion to the tank. The handle is movable between three distinctly different positions. In the first generally vertical position the grasping portion extends over the cap, the handle in the first position being adapted to enable a user to carry the sprayer by the handle. In the second stable position the grasping portion is disposed to one side of the grasping portion in the first position and laterally beyond the cap, the handle in the second position being adapted to secure the tank against rotation without impeding removal of the cap for filling purposes. In the third stable position the grasping portion is disposed to the other side of the grasping portion in the first position and laterally beyond the operative path of the pump handle means, the handle in the third position being adapted to secure the tank against vertical lifting or tipping without impeding movement of the pump handle means and while facilitating movement of the pump handle means by providing a support for the user.

In a preferred embodiment, in the first position the grasping portion of the handle is vertically aligned with and spaced above the pump handle means. In the second position the handle is generally horizontal and the grasping portion is laterally displaced outwardly from the cap. Preferably the grasping portion is also laterally spaced outwardly from the tank and disposed below the top level of the pump handle means. In the third position the grasping portion is disposed higher than the tank and only slightly laterally spaced outwardly from the pump handle means. Preferably the grasping portion is laterally spaced outwardly from the cap, the handle in the third position extending at an acute angle to the handle in the first position.

Preferably the handle is generally U-shaped and pivotally secured to the tank. The cap is preferably adapted to be rotated relative to the tank to enable removal therefrom for filling purposes, the handle in the second position not impeding rotation of the cap but, when held stationary by a user, impeding rotation of the tank.

The tank top preferably includes a stop adapted to be abuttingly engaged by the handle only when the handle is in the third position, the stop limiting the degree to which the handle can be moved to the third position side. The stop is disposed at a level below the pivot axis of the handle and laterally inwardly of the periphery of the tank. The grasping portion of the handle in the third position extends laterally outwardly further than the outermost point of abutment between the stop and the lower surface of the handle.

The present invention facilitates pressurization of air within the sprayer by allowing the handle to be put in the third stable position which is adapted to secure the tank against vertical lifting or tipping during the pressurization operation, without impeding movement of the pump handle means as necessary to achieve pressurization. The handle in the third position indeed facilitates movement of the pump handle means by acting as a support which the user can grasp with one hand to support his upper torso while using his other hand to efect an up-and-down movement of the pump handle means.

DETAILED DESCRIPTION OF THE PREFERRED EMBODIMENTS

Figure 1:
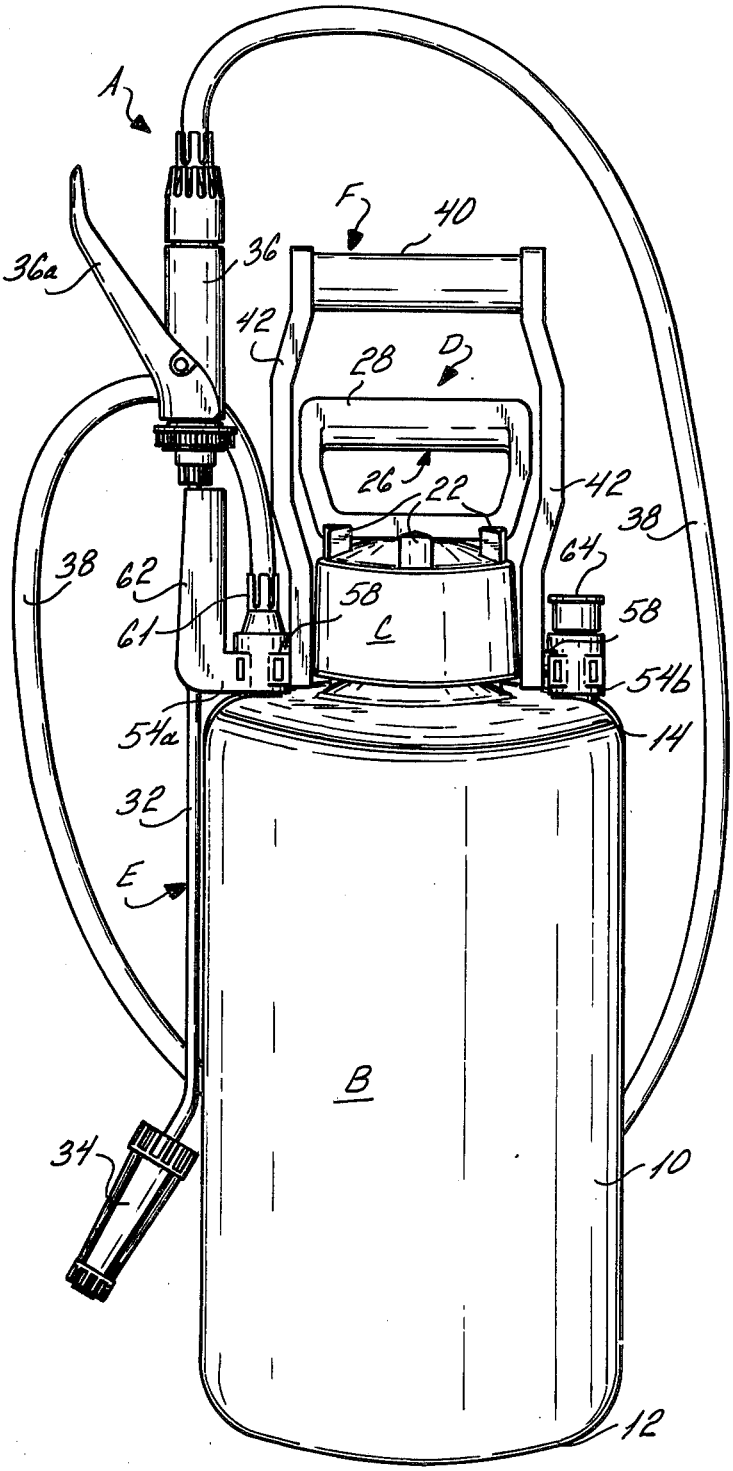
FIG. 1 is an isometric view of a sprayer according to the present invention.
Figure 2:
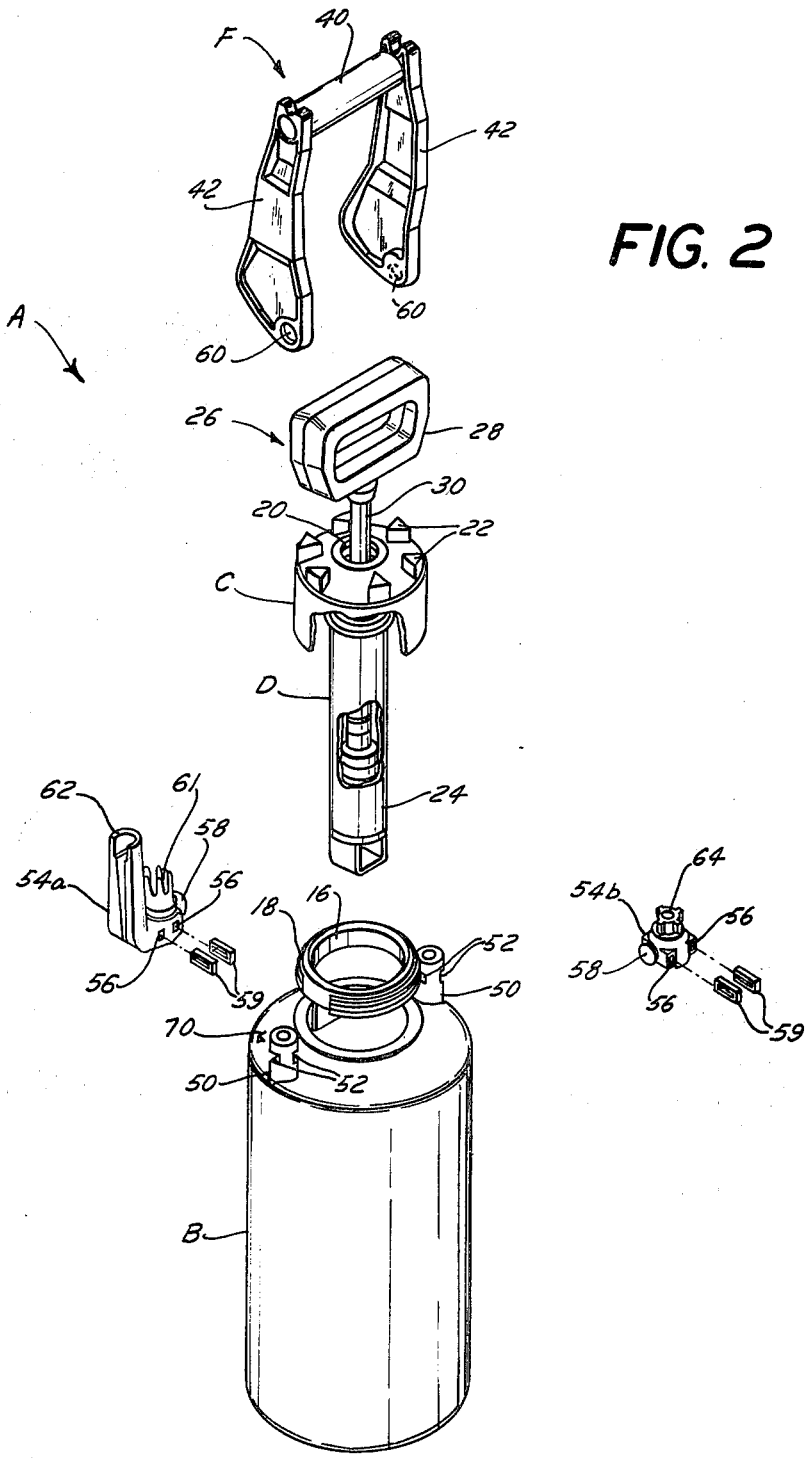
FIG. 2 is an exploded isometric view, to a slightly reduced scale, of the sprayer of FIG. 1.

Referring now to the drawing, and in particular to FIGS. 1 and 2 thereof, therein illustrated is a hand-operated compressed air sprayer A according to the present invention. The tank B of the sprayer A is generally cylindrical in configuration and includes a sidewall 10, a closed bottom 12, and a top 14 defining a centrally located aperture 16 extending therethrough.

An internally threaded cap C is threadingly engaged by a funnel-shaped, externally threaded, raised central portion 18 of the tank top 14. The cap C defines a centrally located aperture 20 extending vertically therethrough as well as a plurality of raised lugs 22 circumferentially spaced about the top of the cap and extending upwardly therefrom.

The pump means D passes through the cap aperture 20 and includes a lower portion 24 disposed below the cap C and pump handle means generally designated 26. The pump handle means 26 includes a hand grip portion 28 disposed above the top of the cap C and a connecting rod 30 which passes through the cap aperture 20 and connects the hand grip portion 28 to the lower pump portion 24. The cap C and pump means D are secured to and removable from the tank B as a unit. The bottom of grip portion 28 of the pump handle means 26 is configured and dimensioned to fit between adjacent ones of the upstanding cap lugs 22 so that the cap C may be loosened or tightened upon the tank B by rotation of the grip means 28 when the sides thereof abut appropriate lugs 22 (as shown in FIG. 1).

The sprayer A may further include a wand assembly E comprised of a rigid wand tube 32 having at one end thereof a nozzle 34 and at the other end thereof a levered grip portion 36 including lever means 36*a* for controlling the flow of fluid therethrough. A flexible hose 38 is connected at one end to the wand grip portion 36 and at the other end to the tank B, the hose 38 serving to maintain the interior of the tank B in fluid communication with the interior of the wand grip portion 36.

The features of the sprayer described above are conventional and hence need not be described in further detail. As with conventional sprayers, the nozzle 34 may be adjustable to provide anything from a fine mist to a jet spray, and the wand tube 32 may be adjustable to control the spray direction. Similarly a safety mechanism may be incorporated in the hand grip portion 36 to prevent the lever 36*a* from being accidentally moved from its released "shut off" position to its depressed "spray" position.

The sprayer handle F comprises a grasping portion 40 disposed remotely from the tank B and adapted to be held by a user and a pair of connecting side portions 42 adapted to connect opposed ends of the grasping portion 40 to the tank top 14. As more cleary shown in FIG. 3 where the handle F is shown in the upright or generally vertical carrying position, the upper ends of the connecting side portions 42 of the handle F are secured together by means of a fastener 44, with the grasping portion 40 being disposed about the fastener 44 to facilitate grasping by the user. Intermediate their ends the connecting side portions 42 are both bowed outwardly slightly so as to accommodate therebetween the grip portion 28 of the pump handle means 26 when the latter is in its lowered position (that is, with the ends of the bottom portion of the grip means 28 being disposed intermediate cap lugs 32). The lower ends of the connecting side portions 42 are apertured and pivotally mounted on the top 14 of tank B in the following manner.

Extending upwardly from the tank top 14 are a pair of curcular hollow lugs 50. The lugs 50 are disposed adjacent opposite ends of a diameter of the tank B, the outer surface of the circumferential sidewall of each lug 50 defining notches 52 both on its inwardly and outwardly facing surfaces. Seated upon each lug 50 is a connector 54 including a pair of spaced parallel apertures 56 extending horizontally therethrough. When the connectors 54 are seated upon their respective lugs 50, the connector apertures 56 communicate with the lug notches 52 to define rectangular passageways. Rectangular fasteners 59 extend through these passageways, one portion of each fastener 59 extending into a lug notch 52 and another portion thereof extending into the connector aperture 56 thereby to interlock associated lugs 50 and connectors 54 against separation. Extending inwardly from each connector 54 is cylindrical finger 58 configured and dimensioned to seat in a cylindrical recess 60 at the lower end of each connecting side portion 42 of the handle F. The pivotal motion of the handle F relative to the tank B reflects a rotation of the fingers 58 within the recesses 60.

While the two connectors 54 are identical in the respects described above, they also differ in certain respects. One connector 54*a* includes conduit means 61 for securing one end of the flexible hose 38 to the tank B so as to maintain the interiors of the hose 38 and tank B in fluid communication. Optionally it may also include supporting means 62 for maintaining the wand assembly E in a convenient storage position during carrying or storage. The other connector 54*b* may optionally include a safety valve 64 to vent excess air pressure developed within the tank B or enable a manual discharge of the air within the tank B prior to storage of the sprayer A.

Preferably the grasping portion 40 of handle F and the upper ends of connecting side portions 42 are aligned to prevent rotation of the grasping portion 40 relative to the connecting side portions 42.

Figure 3:
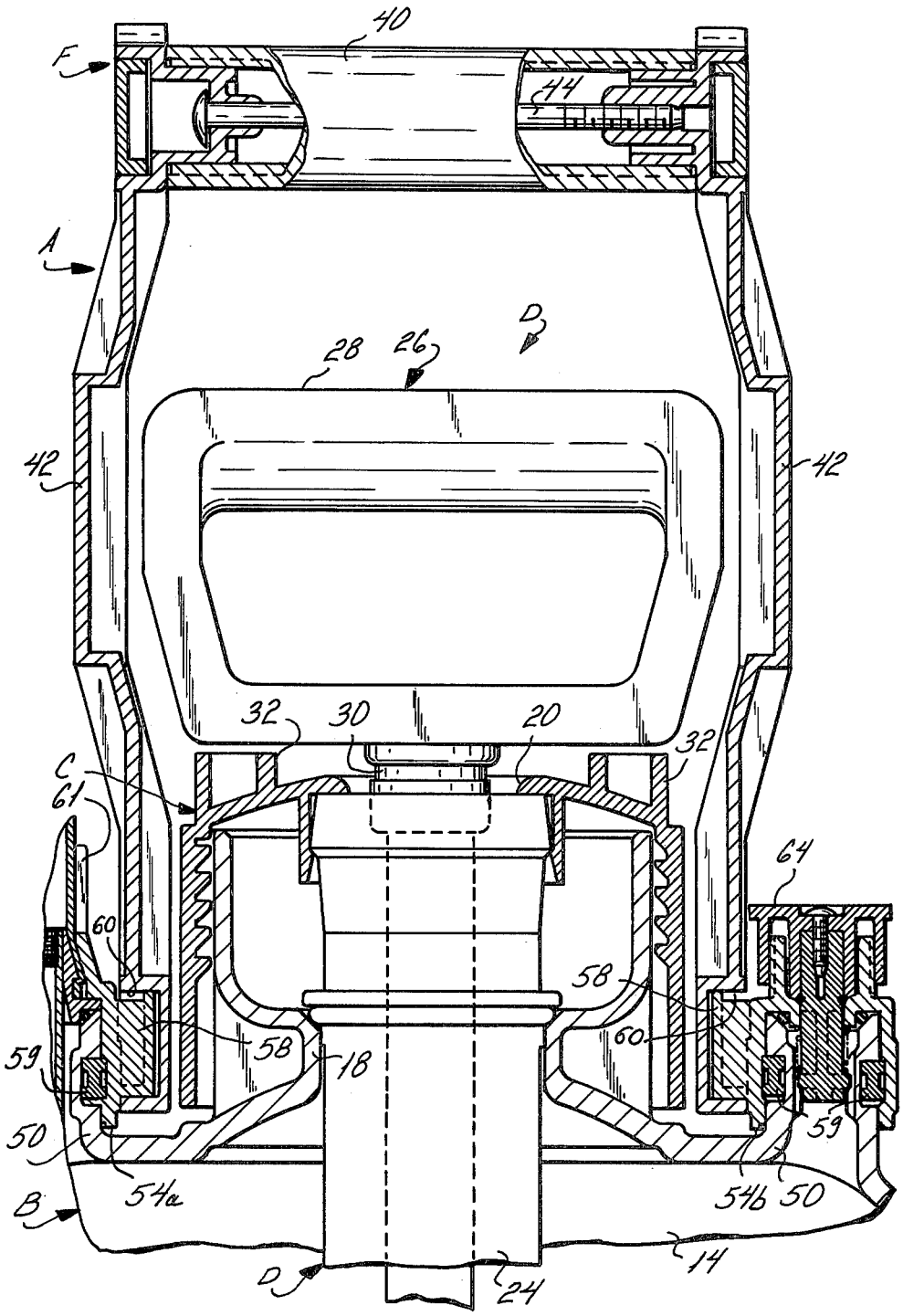
FIG. 3 is a fragmentary exploded side elevation view, to a slightly enlarged scale and partially in cross-section, of the sprayer with the handle shown in the first position.

Referring now to FIG. 3 in particular, therein illustrated is a sprayer A with the handle F in a first generally vertical or upright position wherein the grasping portion 40 extends over the cap C. More particularly, the grasping portion 40 is vertically aligned with and slightly spaced about the pump handle grip portion 28. In this position the handle F interferes somewhat with access of the user to the grip portion 28 and, in any case, prevents the pump handle means 26 from being moved upwardly to its full extent along its generally vertical axis of motion extending through the cap C. (Note in FIG. 4, the handle F in its first position in solid line and the grip portion 28 in its elevated position in phantom line.) The handle F in this position is especially adapted to enable carrying of the sprayer A by the handle F, with the tank B assuming under the influence of gravity a position in which the grip portion 28 extends directly underneath the grasping portion 40.

Figure 5:
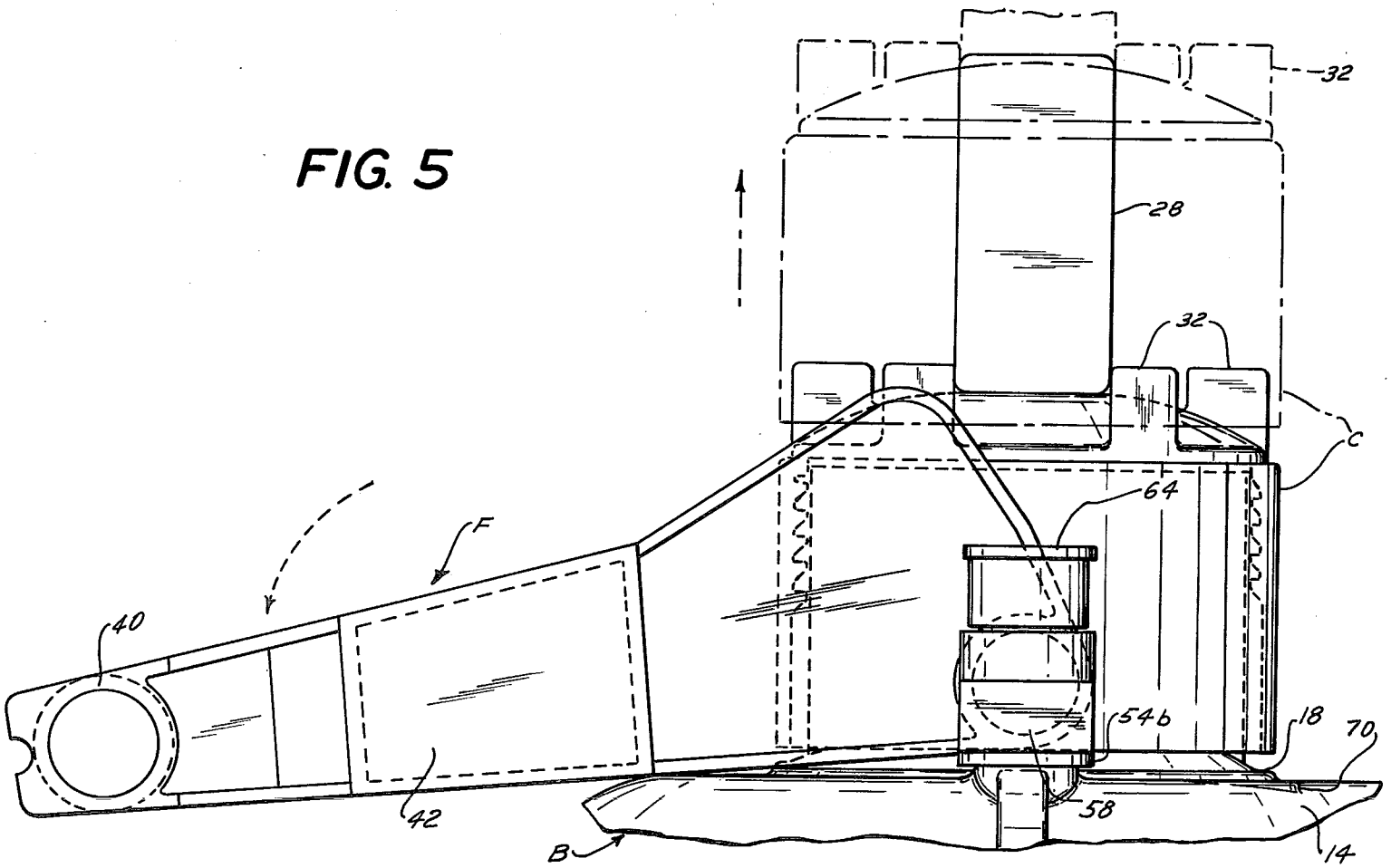
FIG. 5 is a fragmentary and elevation view of the sprayer of FIG. 3, with the handle shown in the second position.

Referring now to FIG. 5 in particular, therein illustrated is the sprayer A with the handle F in the second stable position wherein the grasping portion 40 is disposed to one side of the grasping portion 40 in the first or carrying position and laterally beyond the cap C. The handle F in the second position is adapted to secure the tank B against rotation without impeding removal of the cap C for filling purposes. In the second or filling position, the handle F is generally horizontal with the grasping portion 40 being laterally displaced outwardly from the cap C so as to enable removal of the cap without interference by the handle F. Thus, as illustrated in phantom line in FIG. 5, the cap C may be rotated relative to the tank B thereby unscrewing the cap C and enabling it to be lifted off of the tank B. Unscrewing of the cap C is preferable effected by rotation of the pump handle means 26, and in particular, the grip portion 28 thereof (assuming that the grip portion 28 thereof is in a lowered position so that a portion thereof is intermediate the cap lugs 32). When the handle F is in the second or filling position, preferably the grasping portion 40 is laterally spaced outwardly from the tank B (as well as the cap C) and disposed below the top level of the pump handle means 26. This enables the grasping portion 40 to be held by the user with little tendency of the sprayer to tip or topple over as the user has only to hold the grasping portion 40 and secure it against rotation about the longitudinal axis of the tank B. This is all that is necessary to counter the tendency of the tank B to rotate along with the cap C and thereby prevent the removal of the cap C from the tank B. It will be appreciated, however, that should the user exert a strong downward component of force on the handle grasping portion 40, the entire sprayer A would have a tendancy to topple over in the direction of the handle grasping portion 40. While the handle has been illustrated in FIG. 5 as extending at almost right angles to the longitudinal axis of the tank B, it will be noted that this is only a preferred second position and that other second positions in which the handle axis forms a lesser angle with the tank axis (i.e., extends more uprightly) are also encompassed by the second position, provided only that the hendle F is swung outwardly sufficiently far as not to interfere with rotation of the pump handle means 26 and hence removal of the cap C. Generally any angle greater than about 45° would be suitable for this purpose.

Figure 4:
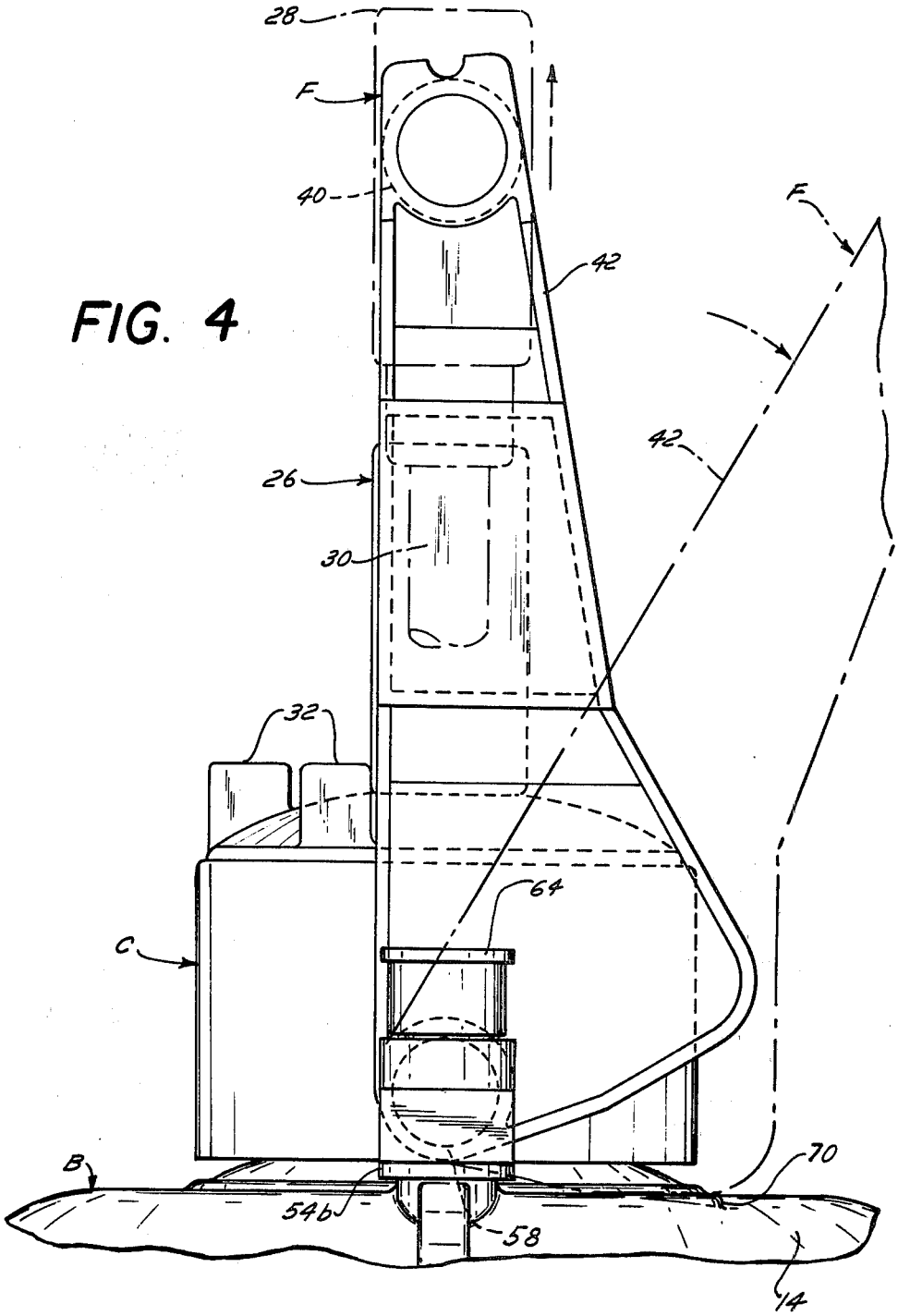
FIG. 4 is a fragmentary end elevation view, of the sprayer of FIG. 3, with the handle shown in the first position in solid line and in the third position in phantom line.

Referring now to FIG. 4 in particular, therein illustrated in phantom line is the sprayer A with the handle F in the third stable position wherein the grasping portion 40 is disposed to the other side of the grasping portion 40 in the first or carrying position and laterally beyond the operative path of the pump handle means 26. The handle F in the third position is adapted not only to stabilize the tank B against vertical lifting or tipping without impeding movement of the pump handle means 26, but also to facilitate movement of the pump handle means 26 with one hand of the user by providing the user with a convenient support for his other hand (and hence his upper torso). In the third or stabilizing position of the handle F, the grasping portion 40 is disposed higher than the top 14 of the tank B and generally higher than either the cap C or the top of pump handle means 26 in its depressed position (that is, when it is at the end of its downstroke). The grasping portion 40 is preferably only slightly laterally spaced from the grip portion 28 when the two are parallel. In other words, the lateral spacing is preferably only sufficient to permit the user to hold the grasping portion 40 of the handle F with one hand and the grip portion 28 of the pump handle means 26 with the other hand and to move the pump handle means 26 upwardly and downwardly along its vertical axis extending through the cap C without having his hands contact one another. The bent-over user can thus rest the weight of his upper torso on the one arm holding the handle F and thereby rest his back muscles while employing merely the arms muscles in his other arm to move the pump handle means 26 up and down along its operative path, thereby reducing the incidence of back fatigue during the pressurizing operation. Preferably the handle F in the third position extends at an acute angle to the handle F in the first or carrying position.

The contour of the bottom of each side connecting portion 42 of the handle F (when the handle is in the third position) and the contour of the portion of the tank top 14 upon which it abuts in the third or stabilizing position are designed to enable the downward force exerted by the user upon the grasping portion 40 (disposed outwardly of the cap C and just inside the outer diameter of the tank B) to be laterally displaced inwardly into a downward force exerted on the tank top 14 well within the outer diameter of the tank B. Thus the tank top 14 includes a pair of raised planar surfaces or ledges 70 adapted to be engaged by the bottom surfaces of the side connecting portions 42 of the handle in and only in the third or stabilizing position, the ledges 70 limiting the degree to which the handle F can move to the third position side, thereby to function as stops for the handle F in its third position. It will be appreciated that the grasping portion 40 of handle F extends laterally outwardly from the axis of the tank B further than the cap C and further than the point of abutment between the lower surface of each side connecting portion 42 and its respective ledge 70. The point of abutment is lower than the pivot axis for the handle (i.e., lower than the level of connector fingers 58) and laterally within the periphery of tank B.

To summarize, the present invention provides a sprayer in which the handle is capable of being moved not only to the first generally vertical or carrying position and a second or filling position, but also a third or stabilizing position which does not interfere with the pressurizing operation and in fact stabilizes the tank against vertical lifting or tipping during the pressurizing operation without impeding movement of the pump handle means and while providing a support for the user.

Now that the preferred embodiments of the present invention have been shown and described in detail, various modifications and improvements thereon will become readily apparent to those skilled in the art. Accordingly the spirit and scope of the present invention is to be limited only by the appended claims and not by the foregoing disclosure.

I claim:

1. In a hand-pressurized compressed air sprayer comprising:

A. a tank for holding fluid, said tank having an open top;

B. a cap removably secured to said tank to cover said open tank top;

c. a pump means operatively secured to said tank for compressing air therein, said pump means including a manually operable pump handle means extending upwardly from said cap and being movable through an operative path along a generally vertical axis extending through said cap; and D. a handle comprising a grasping portion remote from said tank and adapted to be held by a user and a connecting portion connecting said grasping portion to said tank;

the improvement wherein said handle is movable between a first generally vertical position wherein said grasping portion extends over said cap, a second stable position wherein said grasping portion is disposed to one side of said first position of said grasping portion and laterally beyond said cap, and a third stable position wherein said grasping portion is disposed to the other side of said first position of said grasping portion and laterally beyond said operative path of said pump handle means, said handle in said first position being adapted to enable carrying of said sprayer by said handle, said handle in said second position being adapted to secure said tank against rotation without impeding removal of said cap for filling purposes, and said handle in said third position being adapted to stabilize said tank against vertical lifting or tipping without impeding movement of said pump handle means and while providing a support for the user.

2. The sprayer of claim 1 wherein said handle is generally U-shaped.

3. The sprayer of claim 1 wherein in said first position said grasping portion is vertically aligned with and spaced above said pump handle means.

4. The sprayer of claim 1 wherein in said second position said handle is generally horizontal and said grasping portion is laterally displaced outwardly from said cap.

5. The sprayer of claim 4 wherein in said second position said grasping portion is laterally spaced outwardly from said tank.

6. The sprayer of claim 4 wherein in said second position said grasping portion is disposed below the top level of said pump handle means.

7. The sprayer of claim 1 wherein in said third position said grasping portion is disposed higher than said tank and only slightly laterally spaced from said pump handle means.

8. The sprayer of claim 7 wherein in said third position said handle extends at an acute angle to said handle in said first position.

9. The sprayer of claims 7 or 8 wherein said tank top includes a stop adapted to be abuttingly engaged by said handle only when said handle is in said third position, said stop limiting the degree to which said handle can move to said other side.

10. The sprayer of claim 9 wherein said stop is disposed at a level below the pivot axis of said handle and laterally inwardly of the periphery of said tank.

11. The sprayer of claim 9 wherein in said third position said grasping portion extends laterally outwardly from the axis of said tank further than the outermost point of abutment between the lower surface of said handle and said stop.

12. The sprayer of claim 9 wherein said stop is disposed at a level below the pivot axis of said handle.

13. The sprayer of claim 9 wherein said stop is disposed laterally inwardly of the periphery of said tank.

14. The sprayer of claim 1 wherein said cap is adapted to be rotated relative to said tank to enable removal therefrom for filling purposes and said handle in said second position does not impede rotation of said cap.

15. The sprayer of claim 1 wherein said handle is pivotally secured to said tank.

16. The sprayer of claim 1 wherein said tank comprises a cylindrical body having a top, a bottom and a sidewall therebetween, and a neck of reduced diameter, relative to said cylindrical body, disposed on said cylindrical body top and defining said open tank top, and wherein said handle connecting portion physically connects said handle grasping portion and said cylindrical body top.

17. The sprayer of claim 1 wherein said handle in said first position is spaced inwardly from said cylindrical body sidewall.

18. In a hand-pressurized compressed air sprayer comprising:

A. a tank for holding fluid, said tank having an open top;

B. a cap removably secured to said tank to cover said open tank top;

C. a pump means operatively secured to said tank for compressing air therein, said pump means including a manually operable pump handle means extending upwardly from said cap and being movable through an operative path along a generally vertical axis extending through said cap; and D. a handle comprising a grasping portion remote from said tank and adapted to be held by a user and a connecting portion connecting said grasping portion to said tank; the improvement wherein said handle is movable between a first generally vertical position wherein said grasping portion extends over said cap, a second stable position wherein said grasping portion is disposed to one side of said first position of said grasping portion and laterally beyond said cap, and a third stable position wherein said grasping portion is disposed to the other side of said first portion and laterally beyond said operative path of said pump handle means, said handle in said first position being adapted to enable carrying of said sprayer by said handle, said handle in said second position being adapted to secure said tank against rotation without impeding removal of said cap for filling purposes, and said handle in said third position extending at an arcuate angle to said handle in said first position and being adapted to stabilize said tank against vertical lifting or tipping without impeding movement of said pump handle means and while providing a support for the user.

19. In a hand-pressurized compressed air sprayer comprising:

A. a tank for holding fluid, said tank having an open top;

B. a cap removably secured to said tank to cover said open tank top;

C. a pump means operatively secured to said tank for compressing air therein, said pump means including a manually operable pump handle means extending upwardly from said cap and being movable through an operative path along a generally vertical axis extending through said cap; and D. a handle comprising a grasping portion remote from said tank and adapted to be held by a user and a connecting portion connecting said grasping portion to said tank; the improvement wherein said handle is movable between a first generally vertical position wherein said grasping portion extends over said cap, a second stable position wherein said grasping portion is disposed to one side of said first position of said grasping portion and laterally beyond said cap, and a third stable position wherein said grasping portion is disposed to the other side of said first position of said grasping portion and laterally beyond said operative path of said pump handle means, said handle in said first position being adapted to enable carrying of said sprayer by said handle, said handle in said second position being adapted to secure said tank against rotation without impeding removal of said cap for filling purposes, and said handle in said third position being adapted to stabilize said tank against vertical lifting or tipping without impeding movement of said pump handle means and while providing a support for the user;

said tank top including a stop adapted to be abuttingly engaged by said handle only when said handle is in said third position, said stop limiting the degree to which said handle can move to said other side and being disposed at a level below the pivot axis of said handle and laterally inwardly of the periphery of said tank.

* * * * *

UNITED STATES PATENT OFFICE

CERTIFICATE OF CORRECTION

Patent No. 4,192,464 Dated March 11, 1980

Inventor(s) HO CHOW

It is certified that error appears in the above-identified patent and that said Letters Patent are hereby corrected as shown below:

Column 9, line 12, delete "arcuate" and insert --acute--.

Signed and Sealed this

Tenth Day of June 1980

[SEAL]

Attest:

SIDNEY A. DIAMOND

Attesting Officer

Commissioner of Patents and Trademarks